US007025134B2

(12) United States Patent
Byrd et al.

(10) Patent No.: US 7,025,134 B2
(45) Date of Patent: Apr. 11, 2006

(54) SURFACE PULSE SYSTEM FOR INJECTION WELLS

(75) Inventors: Audis C. Byrd, Katy, TX (US); David W. Ritter, Katy, TX (US); Ronald G. Dusterhoft, Katy, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 221 days.

(21) Appl. No.: 10/601,407

(22) Filed: Jun. 23, 2003

(65) Prior Publication Data

US 2004/0256097 A1 Dec. 23, 2004

(51) Int. Cl.
*E21B 43/00* (2006.01)

(52) U.S. Cl. ..... 166/105; 166/107; 166/109; 166/90.1; 166/268; 166/101; 166/153; 417/547; 417/554; 417/557; 57/301

(58) Field of Classification Search ..... 166/268, 166/90.1, 313, 101, 105, 153; 417/547, 554, 417/557

See application file for complete search history.

(56) References Cited

U.S. PATENT DOCUMENTS

| | | | | |
|---|---|---|---|---|
| 3,378,074 | A * | 4/1968 | Kiel | 166/308.4 |
| 3,754,598 | A * | 8/1973 | Holloway, Jr. | 166/249 |
| 3,765,804 | A | 10/1973 | Brandon | 417/540 |
| 4,842,070 | A | 6/1989 | Sharp | 166/288 |
| 4,921,576 | A | 5/1990 | Hurd | 166/270 |
| 5,056,597 | A * | 10/1991 | Stowe, III | 166/303 |
| 5,244,362 | A * | 9/1993 | Conally | 417/403 |
| 5,351,754 | A | 10/1994 | Hardin et al. | 166/249 |
| 5,377,756 | A | 1/1995 | Northrop | 166/267 |
| 5,697,448 | A | 12/1997 | Johnson | 166/369 |
| 5,738,136 | A * | 4/1998 | Rosenberg | 137/12 |
| 5,836,393 | A * | 11/1998 | Johnson | 166/308.1 |
| 6,186,228 | B1 | 2/2001 | Wegener et al. | 166/249 |
| 6,241,019 | B1 * | 6/2001 | Davidson et al. | 166/249 |
| 6,394,181 | B1 | 5/2002 | Schnatzmeyer et al. | 166/250.15 |
| 6,405,796 | B1 | 6/2002 | Meyer et al. | 166/249 |
| 6,405,797 | B1 | 6/2002 | Davidson et al. | 166/249 |

OTHER PUBLICATIONS

M.B. Dusseault, et al. "A New Workover Tool for CHOP Wells," The Petroleum Society Paper 99-77, 1999.
Maurice B. Dusseault, et al. "A Dynamic Pulsing Workover Technique for Wells".
Maurice Dusseault, et al. "Rehabilitating Heavy Oil Wells Using Pulsing Workovers to Place Treatment Chemicals," Petroleum Society, Canadian International Petroleum Conference, Paper 2001-57, 2001.

(Continued)

*Primary Examiner*—Brian E. Glessner
*Assistant Examiner*—Bryan A. Fuller
(74) *Attorney, Agent, or Firm*—John W. Wustenberg; Baker Botts, L.L.P.

(57) ABSTRACT

The present invention relates to petroleum recovery operations, and more particularly, to the use of pulse technology to enhance the effectiveness of waterflooding operations. The systems of the present invention generally comprise an injection means for continually injecting a fluid into the subterranean formation, and a pressure pulsing means for periodically applying a pressure pulse having a given amplitude and frequency to the fluid while the fluid is being injected into the subterranean formation.

33 Claims, 9 Drawing Sheets

OTHER PUBLICATIONS

Prism Production Technologies Inc., et al. Improving Fluid Injection in Porous Media Using Pressure Pulsing Technology (PPT™).

Maurice B. Dusseault, et al. "Removing Mechanical Skin in Heavy Oil Wells," SPE Paper 58718, 2000.

Janbin Wang, et al. "Fluid Enhancement Under Liquid Pressure Pulsing at Low Frequency".

Prism Production Technologies "Improving Chemical Workovers Using Pressure Pulsing".

Maurice Dusseault, et al. "Pressure Pulsing: The Ups and Downs of Starting a New Technology," Technology Brief, Journal of Canadian Petroleum Technology, vol. 39, No. 4, Apr. 2000.

Wavefront Environmental Technologies, Inc. "Pressure Pulse Technology (PPT) for Recovery of Non-Aqueous Phase Liquids," Oceta Environmental Technology Profiles, available at http://www.oceta.on.ca/profiles/Wavefront/PPT_tech.html, Apr. 16, 2003.

C. C. Mei, "Saffman-Taylor instability in porous layer-Viscous fingering," from "Notes on 1.63 Advanced Environmental Fluid Mechanics.", Nov. 2002.

A. S. Cable, et al. "IOR-07 Pulse Injection Technology for IOR," 11th European Symposium on Improved Oil Recovery, Jun. 2001.

Paul Mackay, "Reverse circulation drilling avoids damage to low-pressure gas reservoirs," Petroleum Technology Digest for Independent Producers, World Oil, Mar. 20, 2003.

Foreign communication from a related counterpart application, Sep. 16, 2004.

* cited by examiner

SURFACE PULSE SYSTEM FOR INJECTION WELLS

BACKGROUND

The present invention relates to petroleum recovery operations, and more particularly, to the use of pulse technology to enhance the effectiveness of waterflooding operations.

Where hydrocarbons reside within a subterranean reservoir, such hydrocarbons may be profitably extracted from the reservoir by a variety of recovery techniques. Conventional primary recovery techniques, e.g., recovering hydrocarbons which flow naturally to the surface because the reservoir pressure exceeds the surface pressure, typically succeed in recovering up to about 15% of the reserves in a hydrocarbon reservoir. Conventional secondary techniques, e.g., waterflooding, typically succeed in recovering about 20% to about 30% of the reserves.

Generally, the combination of a secondary recovery technique, e.g., waterflooding, with the use of pressure pulsing is thought to enable the recovery of up to about 30% to about 45% of the reserves. Pressure pulsing as referred to herein will be understood to mean deliberately varying the fluid pressure in the subterranean reservoir through the application of periodic increases, or "pulses," in the pressure of a fluid being injected into the reservoir.

Existing methods of pressure pulsing are problematic for numerous reasons. Pressure pulsing has been performed through the insertion of a pulse-generating apparatus into a subterranean wellbore, often in a location at or near a set of perforations, wherein the apparatus generates a pressure pulse. This is problematic because it is difficult and expensive to perform routine maintenance on the apparatus; a workover rig is often necessary to remove the apparatus from its designated location within the wellbore, wait while the routine maintenance is performed, and then restore the apparatus to its previous location. This becomes even more costly when the wellbore is located offshore; for example, deepwater workover rigs cost $250,000 to $400,000 per day to operate. Still another disadvantage lies in the fact that a pulse-generating apparatus located within a subterranean wellbore can never be networked to pressure pulse multiple wells at one time; it can only pressure pulse the well in which it is located. Still another disadvantage lies in the fact that the power is typically provided by a pneumatic power source, which, inter alia, requires a large cylinder to generate a useful pressure amplitude, dampens the pressure wave, generally requires big exhaust valves, and is generally less reliable than certain other sources of power, e.g., hydraulic power sources.

Pressure pulsing has also been performed through the use of a pulse-generating apparatus attached to a wellhead located above the surface. Pulsing typically occurs either by raising and lowering a string of tubing located within the wellbore, or by employing a flutter valve assembly which periodically opens and closes to permit a fluid to be pumped into the wellbore. The former operation is problematic because, inter alia, the amplitude of the pressure wave is fixed by the weight of the tubing; it is highly difficult to customize the amplitude for operations in wellbores where a narrow difference exists between the normal reservoir pressure and the pressure which fractures the reservoir. The latter operation is problematic because, inter alia, the means of pumping is limited; the periodic closure of the flutter valve assembly forecloses the use of a positive displacement type pump. Furthermore, neither operation continually maintains positive pressure on the subterranean reservoir. Rather, each operation emits a pressure pulse which briefly elevates the reservoir pressure, after which the reservoir pressure is permitted to decline, potentially back to the original baseline pressure. The inability to maintain a constant positive pressure on the reservoir, inter alia, can impair hydrocarbon recovery from the reservoir, and the stresses generated by alternating surges of positive pressure with gradual declines to neutral pressure may also adversely impact the longevity of the surface equipment and possibly the reservoir.

Additionally, no known pressure pulsing technique has reported achieving a pressure pulse with amplitude above about 500 psi; this is problematic in situations where an amplitude above about 500 psi may be required in order for pressure pulsing to beneficially impact hydrocarbon recovery.

SUMMARY

The present invention relates to petroleum recovery operations, and more particularly, to the use of pulse technology to enhance the effectiveness of waterflooding operations.

An example of a method of the present invention is a method of applying a pressure pulse to a subterranean formation, comprising the steps of continuously injecting a fluid into the subterranean formation, and periodically applying a pressure pulse having a given amplitude and frequency to the fluid while the fluid is being injected into the subterranean formation.

An example of a system of the present invention is a system for applying a pressure pulse to a subterranean formation, comprising an injection means for continually injecting a fluid into the subterranean formation; and a pressure pulsing means for periodically applying a pressure pulse having a given amplitude and frequency to the fluid while the fluid is being injected into the subterranean formation.

The objects, features, and advantages of the present invention will be readily apparent to those skilled in the art upon a reading of the description of the preferred embodiments, which follows.

DESCRIPTION OF PREFERRED EMBODIMENTS

The present invention relates to petroleum recovery operations, and more particularly, to the use of pulse technology to enhance the effectiveness of waterflooding operations. In certain embodiments, the present invention provides a system for treating a subterranean formation by pressure pulsing the subterranean formation, and methods for pulsing with such system. While the systems and methods of the present invention are useful in a variety of subterranean applications, they are particularly useful in connection with waterflooding operations, e.g., where water is being injected into a subterranean formation, inter alia, to maintain or increase reservoir pressure.

Figure 1:
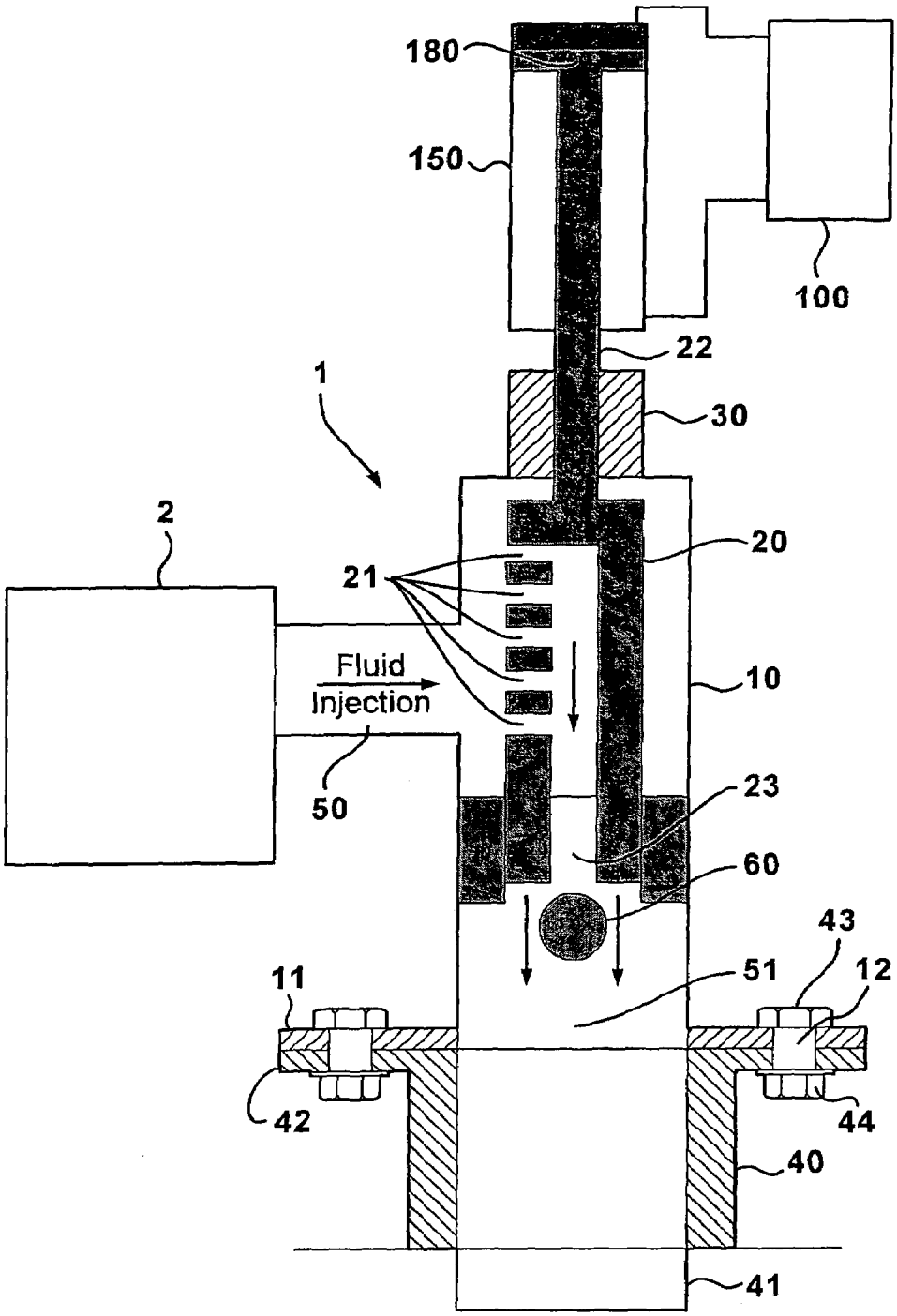
FIG. 1 is a side cross-sectional view of an exemplary embodiment of an apparatus of the present invention assembled atop a wellhead, with a plunger in normal operating position.

Referring to FIG. 1, an exemplary embodiment of an apparatus of the present invention is illustrated and designated generally by the numeral 1. In the embodiment depicted in FIG. 1, apparatus 1 is connected directly to wellhead 40. Apparatus 1 has housing 10 connected to wellhead 40 rising out of the uppermost end of subterranean wellbore 41. Housing 10 may be connected to wellhead 40 in any suitable manner by a wide variety of connective devices. In certain embodiments, housing 10 may be connected to wellhead 40 by means of flanges. In such embodiments, housing 10 has lower flange 11, which lower flange 11 is mated to upper flange 42 of wellhead 40. Where flanges are used to connect housing 10 to wellhead 40, bolts 43 extend upward from upper flange 42, complimentary holes 12 are formed through lower flange 11 for receiving bolts 43, and nut 44 is threaded on each bolt 43 for fastening housing 10 to wellhead 40. One of ordinary skill in the art, with the benefit of this disclosure, will recognize that other equivalent connective devices may be employed.

Figure 8:
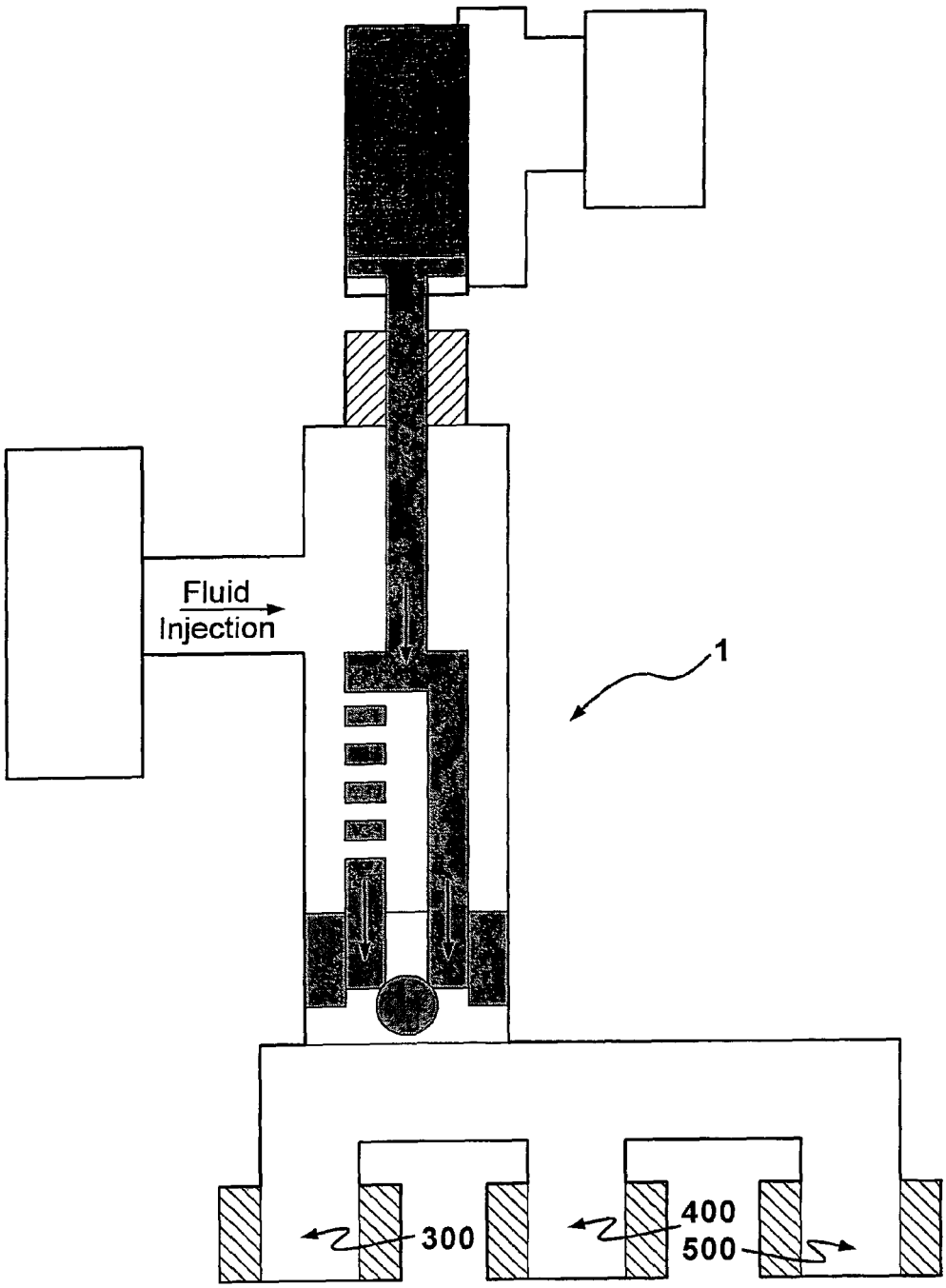
FIG. 8 is a block diagram depicting an exemplary embodiment of an apparatus of the present invention connected to a network of wellheads.

Routine maintenance and repair on the apparatus 1 is therefore facilitated by its location at about, or above, the surface, as opposed to being submerged within the wellbore 41. As seen in FIG. 1, the apparatus 1 may be mounted to the wellhead 40 in some embodiments. In a number of other embodiments, however, the apparatus 1 may be located remotely apart from the wellbore 41. For example, in embodiments wherein pressure pulsing is performed on offshore wells, wellhead 40 may be a subsea wellhead located on the sea floor. In a number of such embodiments, tubing may be connected to the wellhead 40 at one end and to a water injection source at the other end, which water injection source may be located remotely, e.g., on an offshore platform. In such embodiments, the apparatus 1 may be advantageously connected to the water injection source on the offshore platform, as opposed to wellhead 40; accordingly, the apparatus 1 will be remotely located apart from the wellhead 40. Among other advantages, remotely locating the apparatus 1 apart from the wellhead 40 permits pressure pulsing of the subsea wellbore 41 to be performed from the platform, without the need to use a costly offshore workover rig to insert a pulse generator into the wellbore 41. Remotely locating the apparatus 1 apart from the wellhead 40 also, inter alia, facilitates networking the apparatus 1 so that one apparatus 1 may pressure pulse multiple wells, as shown in FIG. 8, which will be discussed later.

Referring again to FIG. 1, a plunger 20 is disposed within housing 10. Plunger 20 is connected to upper stem 22. Upper stem 22 extends upward through housing 10 and is sealed by seal assembly 30 which, inter alia, prevents the contents of housing 10 from leaking around upper stem 22. Upper stem 22 extends through seal assembly 30 and connects to ram 180 within cylinder 150. Cylinder 150 is connected to power pack assembly 100, as shown in greater detail in FIGS. 3, 4, and 5. Power pack assembly 100, and its operation, will be further described later in this specification.

Referring to FIG. 1, housing 10 has a fluid inlet port or fluid injection port 50, through which a fluid that will be pressure pulsed enters apparatus 1. A fluid injection device 2 injects fluid continuously into fluid injection port 50. A wide variety of positive head or positive displacement devices may be suitable for use as fluid injection device 2, including, for example, a storage vessel (for example, a water tower) which discharges fluid via gravity, a pump, and the like. One of ordinary skill in the art, with the benefit of this disclosure, will recognize the appropriate type of fluid injection device 2 for a particular application. In certain embodiments where fluid injection device 2 is a pump, a wide variety of pumps may be used, including but not limited to centrifugal pumps and positive displacement pumps.

Figure 9:
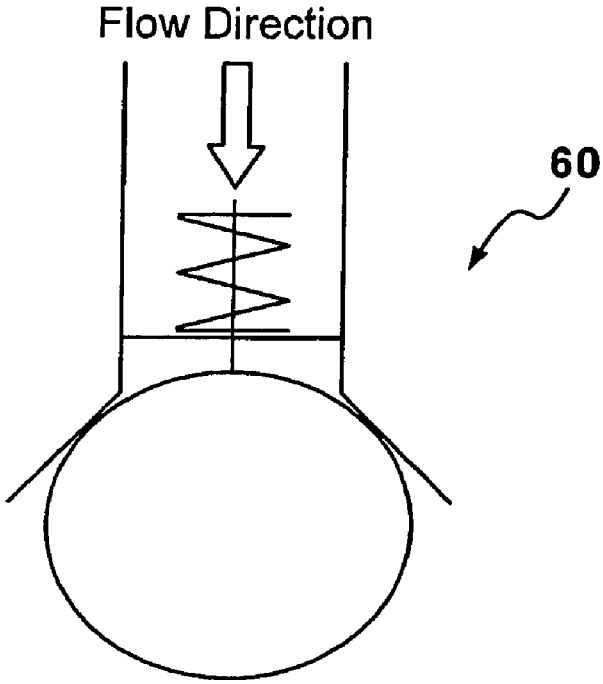
FIG. 9 is a side cross-sectional view of an exemplary embodiment of a ball check valve that may be used in an embodiment of an apparatus of the present invention.
Figure 10:
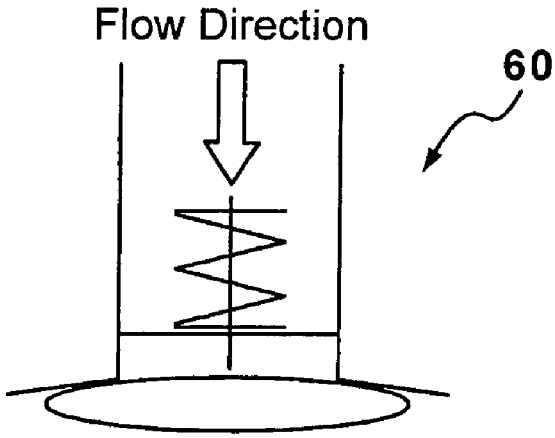
FIG. 10 is a side cross-sectional view of an exemplary embodiment of a dart check valve that may be used in an embodiment of an apparatus of the present invention.
Figure 11:
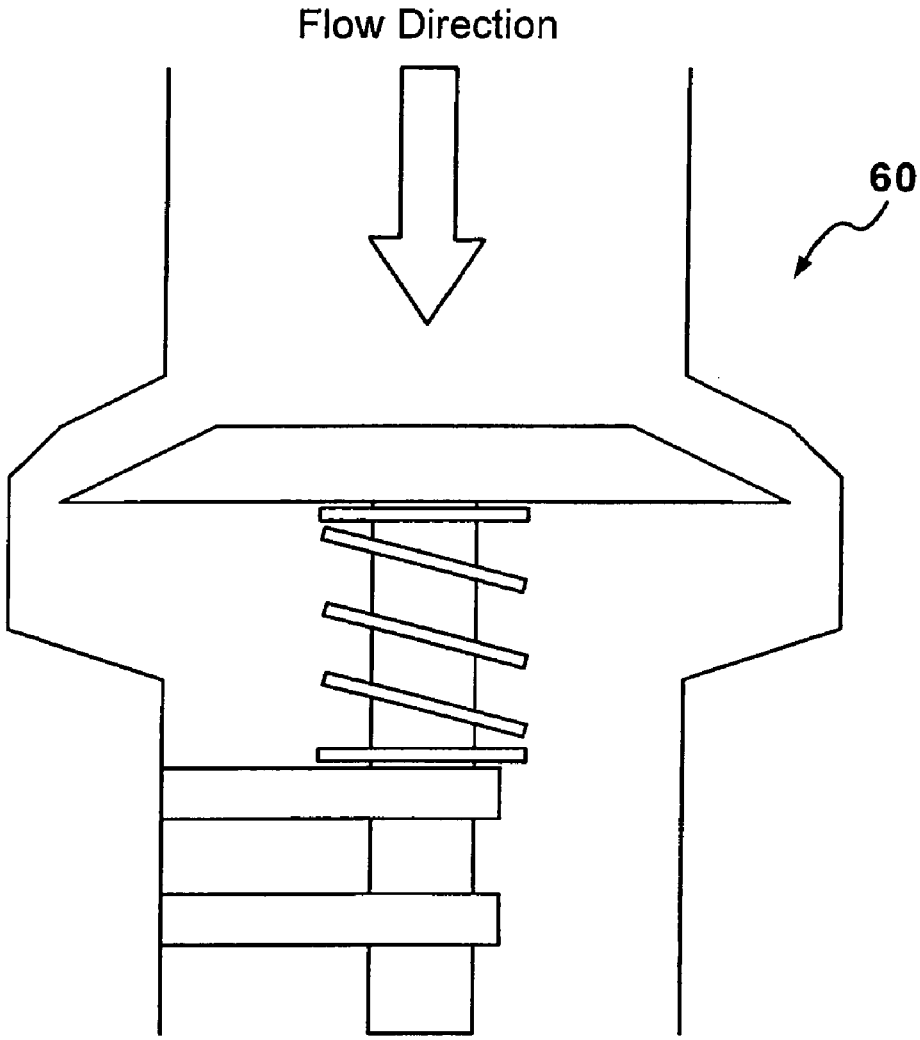
FIG. 11 is a side cross-sectional view of an exemplary embodiment of a spring-loaded check valve that may be used in an embodiment of an apparatus of the present invention.

In the exemplary embodiment depicted in FIG. 1, the fluid which fluid injection device 2 injects continuously into fluid injection port 50 enters plunger 20 through openings 21, which in certain preferred embodiments are disposed along the surface of plunger 20, and which permit the fluid to enter a hollow chamber in plunger 20 and flow downwards through plunger 20 before exiting through plunger outlet 23. In certain embodiments of plunger 20, openings 21 are disposed along the surface of plunger 20 facing fluid injection port 50. Check valve 60 is located within housing 10 a short distance below plunger 20. Outlet port 51 is located below check valve 60. A wide variety of check-type valves may be suitable for use as check valve 60. For example, check valve 60 may be a ball check valve, a dart check valve, a spring-loaded check valve, or other known equivalent device. Exemplary embodiments of ball, dart, and spring-loaded check valves are illustrated by FIGS. 9, 10, and 11, respectively.

Figure 2:
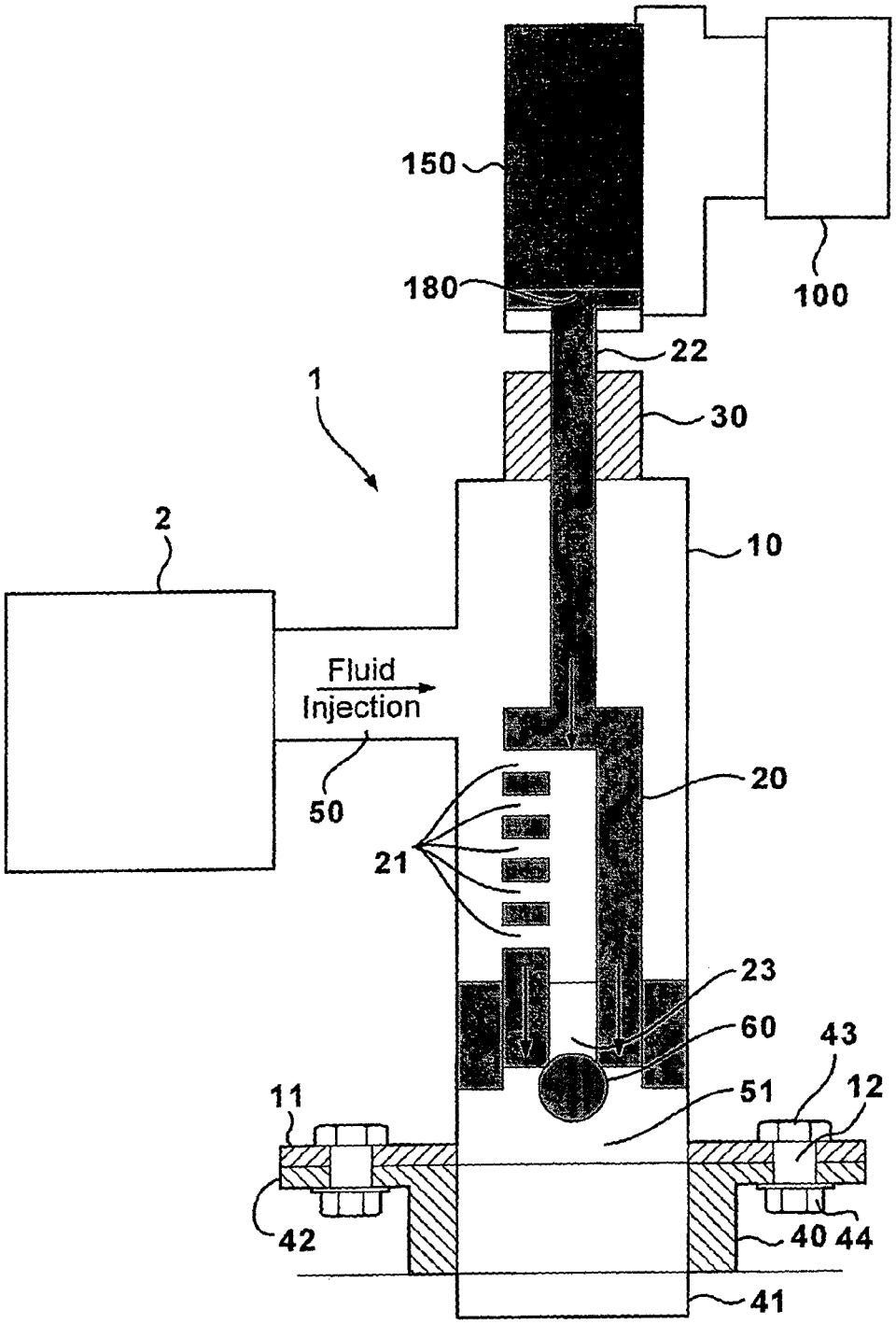
FIG. 2 is a side cross-sectional view of an exemplary embodiment of an apparatus of the present invention assembled atop a wellhead, with a plunger fully downstroked.
Figure 6:
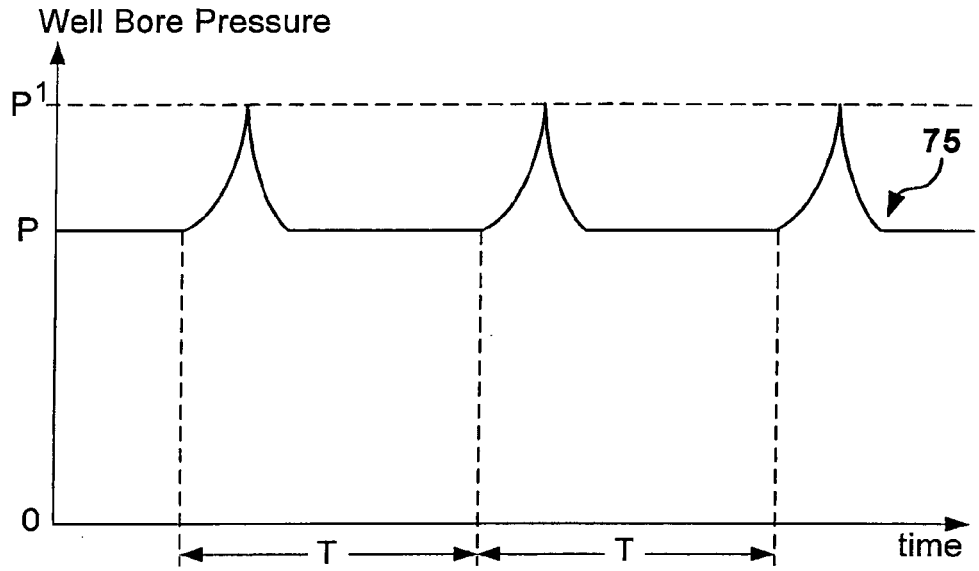
FIG. 6 is a graphical depiction of an amplitude and a frequency of a pressure pulse which may be produced within a subterranean wellbore by an exemplary embodiment of an apparatus of the present invention when used with a method of the present invention.
Figure 7:
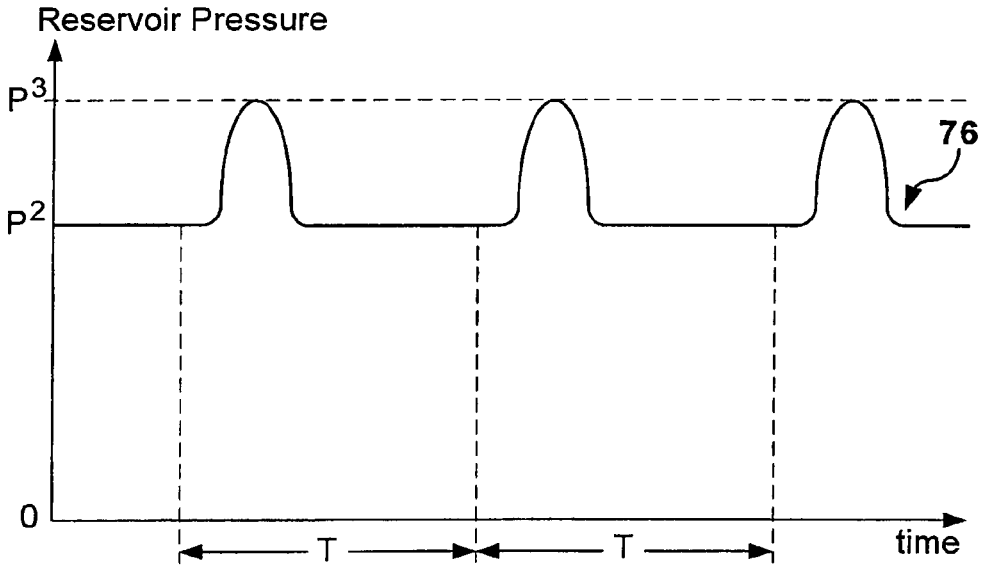
FIG. 7 is a graphical depiction of an amplitude and a frequency of a pressure pulse which may be produced within a subterranean reservoir by an exemplary embodiment of an apparatus of the present invention when used with a method of the present invention.

Returning to the exemplary embodiment illustrated by FIG. 1, during normal operation, check valve 60 is not seated against plunger outlet 23, i.e., check valve 60 is normally open so as to permit the fluid which is continuously entering apparatus 1 through fluid injection port 50 to exit apparatus 1 through plunger outlet 23. When a pressure pulse is called for, however, power pack assembly 100 applies a downward force on ram 180 located within cylinder 150. Ram 180 is connected by upper stem 22 to plunger 20; accordingly, the downward motion of ram 180 applies a downward force upon plunger 20, causing plunger outlet 23 to seat against check valve 60, as depicted in FIG. 2. Continued downward motion of ram 180 compresses the fluid within the housing 10 below plunger 20, briefly elevating the amplitude of the pressure of the fluid being injected into wellbore 41, resulting in a pressure pulse. An exemplary embodiment of an amplitude and a frequency of a pressure pulse are illustrated in FIGS. 6 and 7. After the pulse has been generated, power pack assembly 100 applies an upward force on ram 180, thereby raising upper stem 22 and plunger 20, thus raising plunger 20 within housing 10, unseating plunger outlet 23 from check valve 60, and returning apparatus 1 to normal operating position as depicted in FIG. 1. Power pack assembly 100, and its operation, will be further described later in this specification.

FIG. 2 depicts an exemplary embodiment of an apparatus of the present invention with plunger 20 fully downstroked, and with plunger outlet 23 shown seated against check valve 60. Generally, plunger outlet 23 seats against check valve 60 for a time sufficient to generate a pressure pulse within wellbore 41. In certain preferred embodiments, the time required to generate a pressure pulse is sufficiently small that plunger outlet 23 seats against check valve 60 for a time such that fluid injection through plunger outlet 23 into wellbore 41 is effectively continuous. As FIG. 2 demonstrates, fluid pumped by fluid injection device 2 through fluid injection port 50 continually enters plunger 20 through openings 21, even when plunger 20 is fully downstroked. This facilitates the use of any device as fluid injection device 2, including but not limited to a positive displacement pump whose discharge cannot ordinarily be interrupted without risk of overpressuring a component of the flow system.

Accordingly, the pressure pulse generated by the apparatus 1 of the present invention is generated at the surface, and then propagates through wellbore 41. Among other benefits, this permits the apparatus 1 to be networked so as to pressure pulse multiple wells, as depicted in the exemplary embodiment illustrated in FIG. 8, where a single apparatus 1 is shown networked to pressure pulse wellbores 300, 400, and 500. In certain embodiments where the apparatus 1 is networked among multiple wells, the wells may be spaced as far apart as about 640 acres from each other. In embodiments where the apparatus 1 is networked among multiple wells, the proper spacing of the wells depends on a variety of factors, including but not limited to porosity and permeability of the subterranean formation, and viscosity of the hydrocarbon sought to be recovered from the formation.

Figure 3:
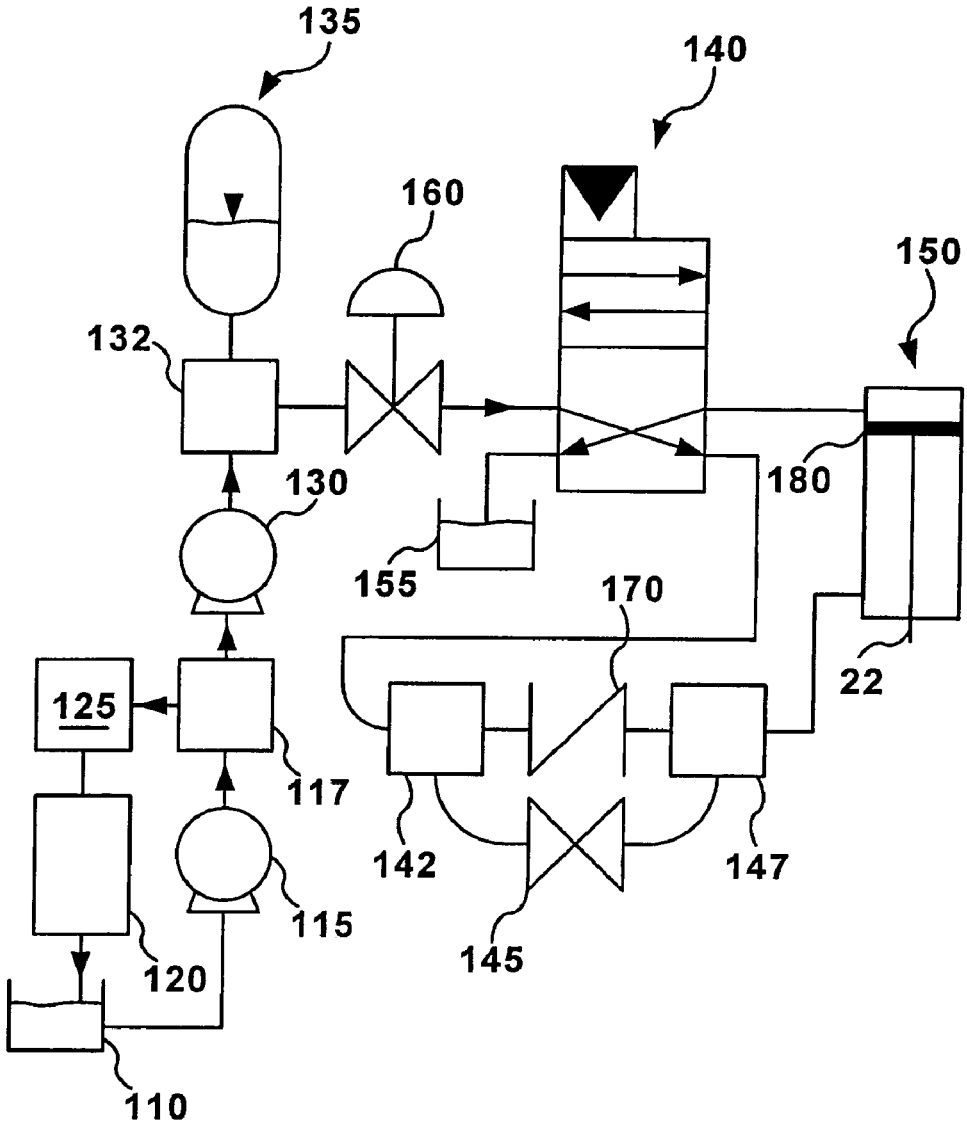
FIG. 3 is a view of an exemplary embodiment of a power pack assembly in accordance with the present invention.

FIG. 3 depicts an exemplary embodiment of power pack assembly 100. In certain preferred embodiments, power pack assembly 100 is a hydraulic power pack assembly. Optionally, power pack assembly 100 may comprise a pneumatic power pack assembly. A hydraulic power pack assembly enables pressure pulsing to be accomplished with smaller, less expensive equipment, and is thought to have improved reliability. As illustrated by FIG. 3, an exemplary embodiment of power pack assembly 100 comprises fluid supply 110, hydraulic pump 130, tee 132, accumulator 135, directional control valve 140, tee 142, upstroke control valve 145, tee 147, cylinder 150, fluid outlet 155, and one-direction bypass valve 170, connected in the manner shown in FIG. 3. Optionally, in embodiments such as those where the fluid in power pack assembly 100 is continually recirculated, power pack assembly 100 may additionally comprise charge pump 115, tee 117, filter 120, and cooler 125, connected as shown in FIG. 3. Optionally, in embodiments where the capability of altering the amplitude of the pressure pulse generated is desirable, power pack assembly 100 further comprises flow modulator 160, as shown in FIG. 3.

Fluid supply 110 comprises any source of a continuous supply of fluid which may be suitable for use in a power pack assembly. In certain embodiments of the present invention, fluid supply 110 comprises a continuous source of water. Hydraulic pump 130 comprises any device suitable for pumping fluid throughout power pack assembly 100. In certain preferred embodiments, hydraulic pump 130 comprises a variable displacement pump. Each of tee 117, tee 132, tee 142, and tee 147 comprises any device capable of permitting at least a portion of a fluid stream to flow along either of two flow paths, following the path of least resistance. In certain preferred embodiments, such tees comprise a T-shaped fitting.

Accumulator 135 is any container having the capability of storing fluid under pressure as a source of fluid power. In certain embodiments, accumulator 135 comprises a gas-charged or a spring-charged pressure vessel. In embodiments where accumulator 135 comprises a gas-charged pressure vessel, the fluid flow into accumulator 135 enters below the gas-liquid interface. While accumulator 135 may be spatially oriented either horizontally or vertically, in certain preferred embodiments, accumulator 135 is oriented vertically. In embodiments where accumulator 135 is a gas-charged pressure vessel, accumulator 135 may be charged with any compressible gas; in certain preferred embodiments, nitrogen is used. Among other functions, accumulator 135 dampens pressure increases which may occur, depending on, inter alia, the position of directional control valve 140. Accumulator 135 also acts as, inter alia, an energy storage device by accepting a portion of the fluid flowing from tee 132, inter alia, for time periods when the volume of cylinder 150 below ram 180 is full of fluid, and plunger 20 (connected to ram 180 by upper stem 22) resides in a fully upstroked position prior to delivering a pressure pulse.

Directional control valve 140 comprises any valve capable of directing the flow of two fluid streams through selected paths. At any given time, directional control valve 140 will comprise two flow paths which accept flow from two sources, and direct flow to two destinations. Further, directional control valve 140 is capable of being repositioned among a first position (which creates two flow paths "A" and "B," which serve a first set of source-destination combinations), and a second position (which creates two flow paths "C" and "D," which serve a second set of source-destination combinations). For example, in an exemplary embodiment illustrated in FIG. 4, directional control valve 140 is positioned in a first position, and accepts flow of a fluid stream from a source, tee 132, and directs this stream through a path "A" within directional control valve 140 towards a destination, tee 142. Simultaneously, in this exemplary embodiment, directional control valve 140 accepts flow of a fluid stream from another source, the top of cylinder 150, and directs this stream through a path "B" within directional control valve 140 towards a destination, fluid outlet 155. When directional control valve 140 is repositioned to a second position, as illustrated by the exemplary embodiment illustrated in FIG. 5, directional control valve 140 accepts flow of a fluid stream from a source, tee 132, and directs this stream through a path "C" within directional control valve 140 towards a destination, the top of cylinder 150. Simultaneously, in this exemplary embodiment illustrated in FIG. 5, directional control valve 140 accepts flow of a fluid stream from a source, the base of cylinder 150, and directs this stream through a path "D" within directional control valve 140 towards a destination, fluid outlet 155. In certain preferred embodiments, directional control valve 140 is a four-way, two-position, single actuator, solenoid-operated control valve. An example of a suitable directional control valve is commercially available from Lexair, Inc., of Lexington, Ky. In certain preferred embodiments, directional control valve 140 is programmed to reposition itself among the first and the second position at a desired frequency. Inter alia, such programming of directional control valve 140 permits a fluid stream to be directed either into the top of cylinder 150 (thereby downstroking ram 180 within cylinder 150) or into the base of cylinder 150 (thereby upstroking ram 180 within cylinder 150), at a desired frequency. Inter alia, this permits plunger 20 (connected to ram 180 by upper stem 22) to be upstroked and downstroked at a desired frequency.

Figure 4:
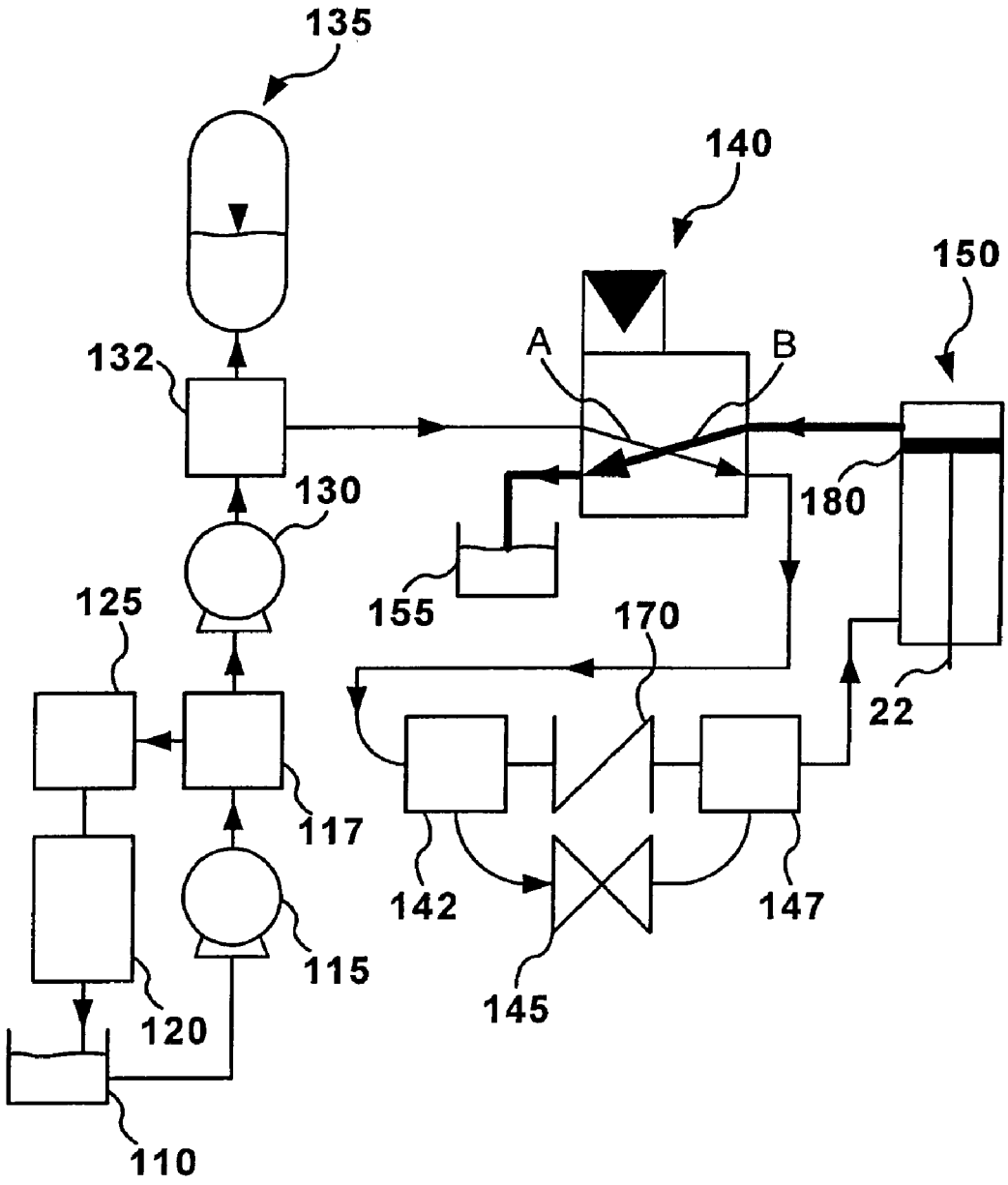
FIG. 4 is a view of an exemplary embodiment of a power pack assembly in accordance with the present invention.

Upstroke control valve 145 is any device which provides the capability to modulate fluid flow to a desired degree. In certain preferred embodiments, upstroke control valve 145 is a modulating control valve, having positions ranging from about fully open to about fully closed. One-direction bypass valve 170 is a check valve permitting fluid to flow in only one direction. In the exemplary embodiment of power pack assembly 100 depicted in FIGS. 3, 4, and 5, one-direction bypass valve 170 is installed so that, inter alia, it permits fluid supplied from tee 147 to flow through one-direction bypass valve 170 towards tee 142, but does not permit flow in the reverse direction (i.e., it does not accept fluid supplied from tee 142). As illustrated by FIG. 4, fluid flowing from tee 142 arrives at the base of cylinder 150 by passing through upstroke control valve 145, but not one-direction bypass valve 170, because only upstroke control valve 145 accepts flow supplied from tee 142. Accordingly, in the exemplary embodiment shown in FIG. 4, the position of upstroke control valve 145 controls the rate at which fluid flows into the base of cylinder 150, thereby, inter alia, impacting the rate of upstroke of ram 180 within cylinder 150. Because ram 180 is connected to plunger 20 by upper stem 22, upstroke control valve 145, inter alia, modulates the rate of upstroke of plunger 20. In certain preferred embodiments, upstroke control valve 145 is adjusted to control the rate of upstroke of plunger 20 to a rate sufficiently slow that the upstroke of plunger 20 does not apply a negative pressure on the reservoir or allow the pressure in wellbore 41 to drop below the reservoir pressure during the time interval between pressure pulse cycles. Referring now to the exemplary embodiment shown in FIG. 5, fluid flowing out of the base of cylinder 150 and through tee 147 is permitted to flow through both one-direction bypass valve 170 and upstroke control valve 145, inter alia, because one-direction bypass valve 170 does accept flow supplied from tee 147. Accordingly, in the exemplary embodiment illustrated by FIG. 5, fluid may be displaced rapidly from the base of cylinder 150 by flowing through both upstroke control valve 145 as well as through one-direction bypass valve 170. Because the rate at which fluid is displaced from the base of cylinder 150 impacts the speed with which ram 180 is downstroked within cylinder 150, the parallel installation of one-direction bypass valve 170 and upstroke control valve 145, inter alia, facilitates very rapid downstroking of plunger 20 (connected to ram 180 by upper stem 22).

Fluid outlet 155 is any means by which fluid may exit power pack assembly 100. In certain optional embodiments wherein the fluid circulating through power pack assembly 100 is continuously recirculated, fluid outlet 155 may be connected to fluid supply 110. In such optional embodiments, the power pack assembly 100 may further comprise charge pump 115, tee 117, filter 120, and cooler 125. Charge pump 115 comprises any device suitable for providing positive pressure to the suction of hydraulic pump 130. Charge pump 115 may be driven by, inter alia, diesel or electric power. Cooler 125 is any device capable of maintaining the recirculating fluid at a desired temperature. In certain preferred embodiments, cooler 125 comprises a heat exchanger. Filter 120 is any device suitable for removal of undesirable particulates within the recirculating fluid.

Flow modulator 160 may be present in optional embodiments wherein, inter alia, it is desired to control the amplitude of the pressure pulse generated. Flow modulator 160 is any device which provides the capability to modulate fluid flow to a desired degree. In certain embodiments, flow modulator 160 is a computer-controlled flow control valve. Flow modulator 160 is used, inter alia, to modulate the flowrate of fluid supplied from tee 132 through directional control valve 140 into the top of cylinder 150, inter alia, to modulate the rate at which plunger 20 (connected to ram 180 by upper stem 22) is downstroked, inter alia, to control the amplitude of the pressure pulse generated to within a desired maximum amplitude. In certain embodiments where, inter alia, flow modulator 160 is computer-controlled, the desired amplitude may be achieved under a variety of conditions.

Figure 5:
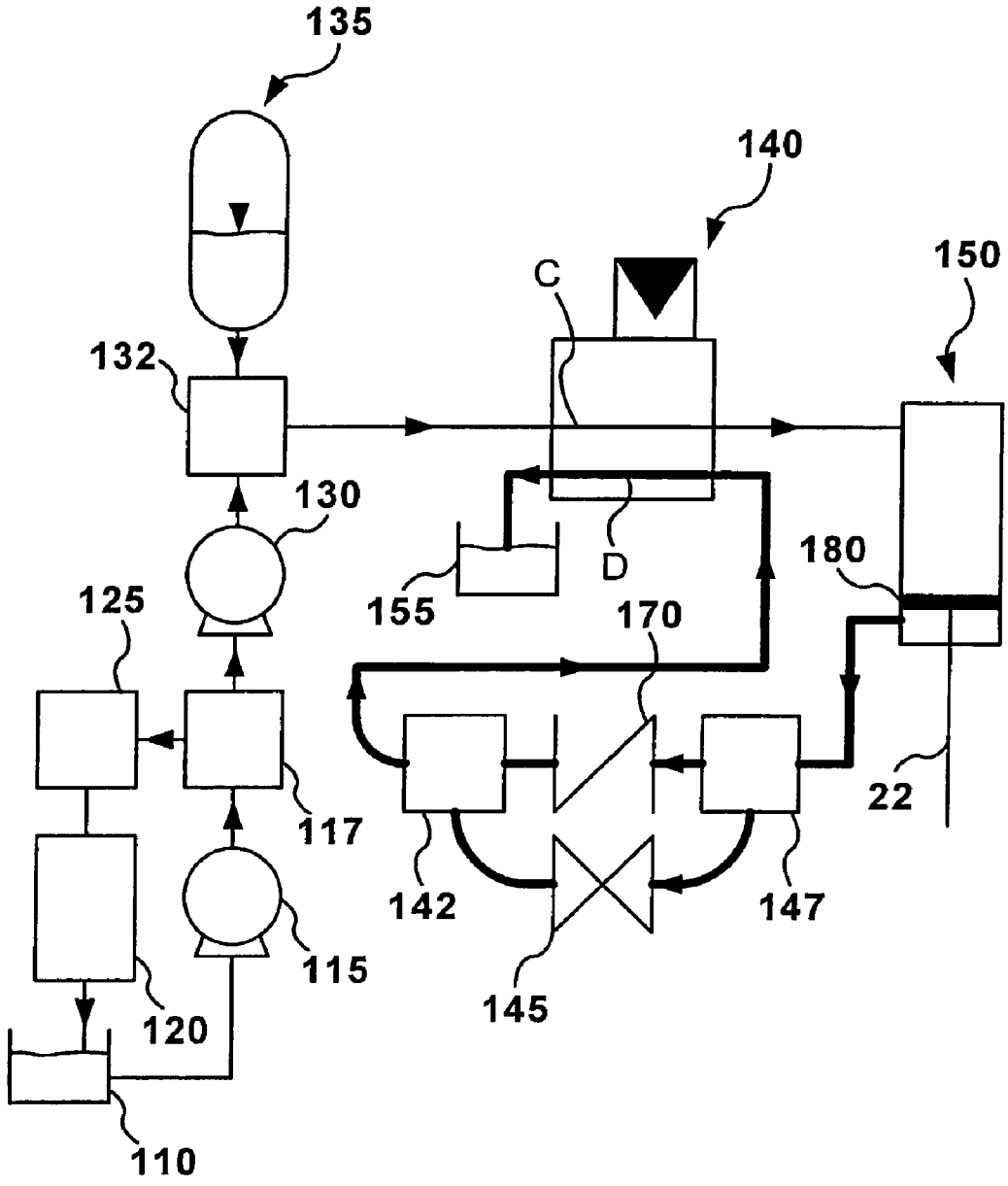
FIG. 5 is a view of an exemplary embodiment of a power pack assembly in accordance with the present invention.

FIG. 4 illustrates an exemplary embodiment of a flow diagram for the relevant streams in power pack assembly 100 under normal operating conditions, e.g., where plunger 20 (connected to ram 180 by upper stem 22) is upstroked, or is in the process of being upstroked. FIG. 5 illustrates an exemplary embodiment of a flow diagram for the relevant streams in power pack assembly 100 under pressure pulsing conditions, e.g., where plunger 20 (connected to ram 180 by upper stem 22) is downstroked or is in the process of being downstroked. Referring now to FIG. 4, fluid supply 110 is shown supplying hydraulic pump 130. The discharge from hydraulic pump 130 flows to tee 132. A portion of the flow from tee 132 flows to accumulator 135, inter alia, building additional pressure and volume within power pack assembly 100. The portion of the fluid entering tee 132 which does not enter accumulator 135 flows to directional control valve 140. As will be recalled, directional control valve 140 is capable of being repositioned among the first position (which creates two flow paths "A" and "B," which serve the first set of source-destination combinations), and the second position (which creates two flow paths "C" and "D," which serve the second set of source-destination combinations). As shown in FIG. 4, under normal conditions, path "A" of directional control valve 140 permits fluid to supply the base of cylinder 150. Therefore, as illustrated by FIG. 4, fluid normally flows from tee 132 into path "A" of directional control valve 140, and thereafter into tee 142. From tee 142, fluid flows solely through upstroke control valve 145, because one-direction bypass valve 170 is a one-way check valve which does not accept flow from tee 142. From upstroke control valve 145, fluid flows through tee 147 and into the base of cylinder 150, imparting an upward pressure upon ram 180 within cylinder 150 by keeping the volume of cylinder 150 below ram 180 full of fluid, maintaining ram 180 (and, thereby, plunger 20) in an upstroked position. As FIG. 4 illustrates, path "B" of directional control valve 140 is orientated under normal conditions so as to connect the top of cylinder 150 with fluid outlet 155, represented by the flow stream indicated by heavy black lines. Where plunger 20 is in the process of being upstroked, all fluid within cylinder 150 above ram 180 exits the top of cylinder 150, and flows through path "B" of directional control valve 140, and into fluid outlet 155. Once plunger 20 arrives at a fully upstroked position, cylinder 150 will be full of fluid, and all fluid above ram 180 will have already been displaced through the top of cylinder 150; therefore, once plunger 20 is fully upstroked, no fluid flows through path "A" or path "B" of directional control valve 140 until after a pressure pulse has been delivered and plunger 20 must once more be upstroked. Rather, once plunger 20 is fully upstroked, flow from tee 132 accumulates in accumulator 135 until a pressure pulse is to be delivered. In certain embodiments, the speed of hydraulic pump 130, the position of upstroke control valve 145, and the frequency at which directional control valve 140 repositions itself may be coordinated so that a pressure pulse is delivered within a desired time after plunger 20 has been fully upstroked. One of ordinary skill in the art, with the benefit of this disclosure, will be able to recognize how such coordination may be accomplished.

FIG. 5 illustrates an exemplary embodiment of power pack assembly 100 during the delivery of a pressure pulse. From FIG. 5, it will be seen that when it is desired to downstroke ram 180 (and, thereby, plunger 20), thereby generating a pressure pulse, directional control valve 140 changes positions such that path "C" of directional control valve 140 permits fluid to flow from tee 132 into the top of cylinder 150, whereas path "D" accepts fluid displaced from the base of cylinder 150 and permits it to flow into fluid outlet 155. In certain embodiments, directional control valve 140 changes positions in response to a signal from a computer controller; in certain other embodiments, the position of directional control valve 140 may be manually changed. In FIG. 5, the flow of fluid displaced from the base of cylinder 150 is represented by the flow stream indicated by heavy black lines. When it is desired to downstroke ram 180 (and, thereby, plunger 20), fluid flows from tee 132 through path "C" of directional control valve 140, and enters cylinder 150 above ram 180, thereby imparting a downward pressure upon ram 180 (and downstroking plunger 20), and displacing the fluid below ram 180 within cylinder 150. This displaced fluid flows into tee 147, and flows through both upstroke control valve 145 and one-direction bypass valve 170, following the path of least resistance. Inter alia, the flow of fluid displaced from the base of cylinder 150 through both one-direction bypass valve 170 and upstroke control valve 145 assists in removing the displaced fluid as rapidly as possible, thereby, inter alia, permitting ram 180 within cylinder 150 to be downstroked as rapidly as possible, thereby, inter alia, permitting plunger 20 (connected to ram 180 by upper stem 22) to generate a pressure pulse as rapidly as possible. Additional fluid volume and pressure stored in accumulator 135 assist in further increasing the speed of the downstroke by flowing through tee 132, then through path "C" of directional control valve 140 into the top of cylinder 150. The displaced fluid flowing through upstroke control valve 145 and one-direction bypass valve 170 then enters tee 142, flows through path "D" of directional control valve 140 and into fluid outlet 155. In certain embodiments, such as those where it is desired to control the speed of the downstroke, flow modulator valve 160 may be installed, inter alia, to modulate the flow of fluid from tee 132 to path "C" of directional control valve 140, thereby, inter alia, controlling the speed of the downstroke to a desired speed.

When the pressure pulse has been generated and plunger 20 is to be returned to its upstroked position, directional control valve 140 changes positions again such that, as has been previously discussed and as will be seen from FIG. 4, fluid flows from tee 132 through path "A" of directional control valve 140 and ultimately into the base of cylinder 150, whereas path "B" of directional control valve 140 accepts fluid displaced from the top of cylinder 150 and permits it to flow into fluid outlet 155. In certain preferred embodiments, upstroke control valve 145 is adjusted to control the rate of upstroke of plunger 20 to a rate sufficiently slow that the upstroke of plunger 20 does not apply a negative pressure on the reservoir or allow the pressure in wellbore 41 to drop below the reservoir pressure during the time interval between pressure pulse cycles.

Returning to FIG. 3, other features of the power pack assembly 100 may be seen. In certain optional embodiments wherein the circulating fluid is continuously recirculated (e.g., where fluid exiting fluid outlet 155 returns to fluid supply 110), fluid supply 110 supplies fluid to charge pump 115, which discharges fluid to tee 117. One of the fluid streams exiting tee 117 supplies cooler 125, and the other fluid stream exiting tee 117 supplies hydraulic pump 130. The fluid stream exiting cooler 125 then passes through filter 120, then returns to fluid supply 110.

Certain embodiments of power pack assembly 100 provide the capability of, inter alia, varying the rate at which ram 180 is downstroked within cylinder 150, thereby, inter alia, varying the force applied to plunger 20 (connected to ram 180 by upper stem 22); this, inter alia, varies the amplitude of the corresponding pressure pulse which is generated. In certain of such embodiments where the capability of altering the amplitude of the pressure pulse generated is desirable, the discharge from tee 132 flows to flow modulator 160, as shown in FIG. 3. In certain embodiments of the present invention, the amplitude of each pressure pulse may be tightly controlled to within about 10 psi of a target pressure. In certain of these latter embodiments, flow modulator 160 receives a continuous signal from a pressure transmitter located within wellbore 41, which signal communicates the pressure in wellbore 41; when a pressure pulse is to be delivered, flow modulator 160 then modulates the flow of fluid in accordance with the desired amplitude of the pressure pulse, and the pressure in wellbore 41. One of ordinary skill in the art, with the benefit of this disclosure, will understand how flow modulator 160 may be programmed so that a pressure pulse of a given amplitude may be generated. Among other benefits, this enables the systems and methods of the present invention to be advantageously used even in subterranean formations where only a narrow difference, e.g., less than about 50 psi, exists between the reservoir pressure and the pressure which would fracture the reservoir. Generally, the pressure pulse will have an amplitude sufficient to stimulate oil production from the reservoir. More particularly, the pressure pulse will have an amplitude in the range of from about 100 psi to about 3,000 psi. In preferred embodiments, the pressure pulse will have an amplitude in the range of about 50% to about 80% of the difference between fracture pressure and reservoir pressure. In some embodiments, the apparatus and methods of the present invention may be used to generate pressure pulses with an amplitude exceeding the fracture pressure of the reservoir, where such fracturing is desirable.

FIGS. 6 and 7 depict embodiments of the typical changes in pressure seen in a subterranean wellbore and a subterranean reservoir before and after pressure pulsing by the apparatus and methods of the present invention. As seen in FIG. 6, wellbore pressure 75 initially demonstrates a positive pressure P, due to, inter alia, continuous injection of fluid into the wellbore. A pressure pulse is then performed at the surface while the fluid is being injected. When the pressure pulse is delivered, wellbore pressure 75 is elevated to a pulsed pressure $P^1$ for the entire duration of the pulse. Generally, pulsed pressure $P^1$ is a pressure sufficient to stimulate hydrocarbon production from the reservoir. More particularly, pulsed pressure $P^1$ may range from about 100 psi to about 3,000 psi. After the pulse, wellbore pressure 75 returns to its original pressure P as fluid leaks off into the reservoir. After a time T, the pulse is repeated; the pulse therefore has a frequency of 1/T. Generally, the frequency is a frequency sufficient to stimulate hydrocarbon production from the reservoir. More particularly, the frequency may be in the range of from about 0.001 Hz to about 1 Hz. FIG. 7 depicts an exemplary embodiment of reservoir pressure 76 during the same period of time. As seen in FIG. 7, reservoir pressure 76 demonstrates a positive pressure $P^2$ due to, inter alia, continuous injection of fluid into the reservoir. After a pressure pulse is delivered at the surface by the apparatus and methods of the present invention, reservoir pressure 76 rises to a pulsed pressure $P^3$ for a duration approaching the duration of the pulse. Reservoir pressure 76 then gradually returns to its original pressure $P^2$ as fluid leaks off into the reservoir. The dampening effect of the fluid in the subterranean reservoir may be seen by comparing the relatively sharp changes in wellbore pressure 75 depicted in FIG. 6 with the more gradual changes in reservoir pressure 76 depicted in FIG. 7.

The apparatus and methods of the present invention may be used in a wide variety of subterranean applications. In certain embodiments, the apparatus and methods may be advantageously used in oil fields where the majority of wellbores have depths less than about 2000 feet, and contain oil having an API gravity less than about 20.

Therefore, the present invention is well adapted to carry out the objects add attain the ends and advantages mentioned as well as those that are inherent therein. While numerous changes may be made by those skilled in the art, such changes are encompassed within the spirit of this invention as defined by the appended claims.

What is claimed is:

1. A system for applying a pressure pulse to a subterranean formation, comprising:

means for continually injecting a fluid into the subterranean formation; and means for periodically applying a pressure pulse having a given amplitude and frequency to the fluid while the fluid is being injected into the subterranean formation; wherein:

the injection means and pressure pulsing means are located at about, or above, the earth's surface; and the pressure pulsing means comprises:

a housing;

a plunger disposed in the housing, wherein the plunger has a hollow chamber in fluid communication with the fluid injection port through openings in the surface of the plunger, and the hollow chamber is in fluid communication with the outlet port through a plunger outlet;

a power source for moving the plunger within the housing;

a fluid injection port through which the fluid is supplied into the housing; and an outlet port through which the fluid exits the housing.

2. The system of claim 1 wherein the pressure pulsing means further comprises a check valve in fluid communication with the hollow chamber.

3. The system of claim 1 wherein the power source is hydraulic or pneumatic.

4. The system of claim 1 wherein the pressure pulsing means applies a pressure pulse when the power source applies a downward force upon the plunger, causing the plunger to travel downward, and thereby compress the fluid in the housing.

5. The system of claim 4 wherein the amplitude of the pressure pulse generated may be varied by varying the downward force applied by the power source to the plunger.

6. The system of claim 4 wherein the amplitude of the pressure pulse may be controlled to within about 10 psi of a target pressure.

7. The system of claim 1 wherein the amplitude of the pressure pulse is sufficient to stimulate hydrocarbon recovery from the subterranean formation.

8. The system of claim 7 wherein the amplitude of the pressure pulse is in the range of from about 100 psi to about 3,000 psi.

9. The system of claim 1 wherein the frequency of the pressure pulse is a frequency sufficient to stimulate hydrocarbon recovery from the subterranean formation.

10. The system of claim 9 wherein the frequency is in the range of from about 0.01 Hz to about 1 Hz.

11. The system of claim 1 wherein the injection means and/or the pressure pulsing means is mounted to a wellhead of a wellbore which penetrates the subterranean formation.

12. The system of claim 1 wherein the injection means and/or the pressure pulsing means is remotely located to a wellbore penetrating the subterranean formation.

13. The system of claim 1 further comprising a network of conduits connecting the pressure pulsing means to a plurality of wellbores.

14. A system for applying a pressure pulse to a subterranean formation comprising:

a pump for continuously injecting a fluid into the subterranean formation; and a pressure pulse application device for applying a pressure pulse having a given amplitude and frequency to the fluid while the fluid is being injected into the subterranean formation, the pressure pulse application device comprising:

a housing comprising:

a fluid inlet port through which the fluid is supplied into the housing; and a fluid outlet port through which the fluid exits the housing;

a fluid supply connected to the fluid inlet port;

a plunger disposed in the housing, wherein the plunger has a hollow chamber in fluid communication with the fluid injection port through openings in the surface of the plunger, and the hollow chamber is in fluid communication with the outlet port through a plunger outlet; and a power source for moving the plunger.

15. The system of claim 14 wherein the pressure pulse application device generates a pressure pulse when the power source applies a downward force upon the plunger, causing the plunger to travel downward, and thereby compress the fluid in the housing.

16. The system of claim 14 further comprising a network of conduits connecting the fluid outlet port to a plurality of wellbores.

17. The system of claim 14 further comprising a check valve in fluid communication with the hollow chamber.

18. The system of claim 14 wherein the power source is hydraulic or pneumatic.

19. The system of claim 14 wherein the amplitude of the pressure pulse generated may be varied by varying a downward force applied by the power source to the plunger.

20. The system of claim 19 wherein the amplitude of the pressure pulse may be controlled to within about 10 psi of a target pressure.

21. The system of claim 14 wherein the amplitude of the pressure pulse generated is sufficient to stimulate hydrocarbon recovery from the subterranean formation.

22. The system of claim 21 wherein the amplitude of the pressure pulse generated is in the range of from about 100 psi to about 3,000 psi.

23. The system of claim 14 wherein the pressure pulse is generated at a frequency sufficient to stimulate hydrocarbon recovery from the subterranean formation.

24. The system of claim 23 wherein the frequency is in the range of from about 0.01 Hz to about 1 Hz.

25. The system of claim 14 wherein the system is located at about, or above, the earth's surface.

26. A system for applying a pressure pulse to a subterranean formation, comprising:

means for continually injecting a fluid into the subterranean formation; and means for periodically applying a pressure pulse having a given amplitude and frequency to the fluid while the fluid is being injected into the subterranean formation, the pressure pulsing means comprising:

a housing;

a fluid injection port through which the fluid is supplied into the housing;

an outlet port through which the fluid exits the housing;

a plunger disposed in the housing, the plunger having a hollow chamber in fluid communication with the fluid injection port through openings in the surface of the plunger, the hollow chamber being in fluid communication with the outlet port through a plunger outlet; and a power source for moving the plunger within the housing.

27. The system of claim 26 wherein the pressure pulsing means further comprises a check valve in fluid communication with the hollow chamber.

28. The system of claim 26 wherein the power source is hydraulic or pneumatic.

29. The system of claim 26 wherein the pressure pulsing means applies a pressure pulse when the power source applies a downward force upon the plunger, causing the plunger to travel downward, and thereby compress the fluid in the housing.

30. The system of claim 29 wherein the amplitude of the pressure pulse generated may be varied by varying the downward force applied by the power source to the plunger.

31. The system of claim 29 wherein the amplitude of the pressure pulse may be controlled to within about 10 psi of a target pressure.

32. A system for applying a pressure pulse to a subterranean formation, comprising:

means for continually injecting a fluid into the subterranean formation;

means for periodically applying a pressure pulse having a given amplitude and frequency to the fluid while the fluid is being injected into the subterranean formation, the pressure pulsing means comprising:

a housing;

a plunger disposed in the housing, wherein the plunger has a hollow chamber in fluid communication with the fluid injection port through openings in the surface of the plunger, and the hollow chamber is in fluid communication with the outlet port through a plunger outlet;

a power source for moving the plunger within the housing, the power source comprising an accumulator capable of storing fluid under pressure;

a fluid injection port through which the fluid is supplied into the housing; and an outlet port through which the fluid exits the housing.

33. The system of claim 32, wherein the accumulator comprises a gas-charged or spring-charged pressure vessel.

* * * * *